US009341437B1

(12) United States Patent
Huang

(10) Patent No.: US 9,341,437 B1
(45) Date of Patent: May 17, 2016

(54) COMPACT RECOIL MANAGEMENT SYSTEM

(71) Applicant: George Huang, Henderson, NV (US)

(72) Inventor: George Huang, Henderson, NV (US)

( * ) Notice: Subject to any disclaimer, the term of this patent is extended or adjusted under 35 U.S.C. 154(b) by 0 days.

(21) Appl. No.: 14/738,607

(22) Filed: Jun. 12, 2015

(51) Int. Cl.
*F41A 21/00* (2006.01)
*F41C 23/06* (2006.01)

(52) U.S. Cl.
CPC ..... *F41C 23/06* (2013.01)

(58) Field of Classification Search
USPC ..... 42/1.06, 69.02; 89/177, 198, 199
See application file for complete search history.

(56) References Cited

U.S. PATENT DOCUMENTS

2010/0050492 A1* 3/2010 Faifer ..... F41A 3/82 42/1.06
2010/0251588 A1* 10/2010 Kincel ..... F41A 3/84 42/1.06
2013/0319217 A1* 12/2013 Gangl ..... F41A 3/84 89/198
2014/0059909 A1* 3/2014 Caudle ..... F41A 3/84 42/1.06
2015/0192380 A1* 7/2015 Hilsabeck ..... F41A 25/12 42/1.06

* cited by examiner

*Primary Examiner* — J. Woodrow Eldred
(74) *Attorney, Agent, or Firm* — Shaddock Law Group, PC

(57) ABSTRACT

A compact recoil management system having a buffer tube; an external recoil spring positioned within the internal buffer tube cavity; a buffer having a buffer extension portion, a buffer body portion, a first buffer shoulder, a second buffer shoulder, and a buffer head portion; an end cap that extends from the buffer head portion; a spacer that is slidable along at least a portion of the buffer body portion, and wherein the spacer is slidable within an internal cavity of the buffer tube; an internal recoil spring that is positioned along at least a portion of the buffer body portion, between the buffer head portion and the spacer; and a buffer head attached or coupled to the buffer extension portion.

20 Claims, 15 Drawing Sheets

COMPACT RECOIL MANAGEMENT SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to a compact recoil management system for a firearm.

2. Description of Related Art

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

Various firearms, such as, for example, the AR-15 or M-4 style firearms utilize a variable position buttstock 2 that is slidable and lockable at various positions along a buffer tube 5. A typical variable position buttstock 2 can be locked into a collapsed position, as illustrated in FIG. 1, or locked into a fully extended position, as illustrated in FIG. 2.

As further illustrated in FIGS. 3 and 4, the typical buffer tube 2 includes a capped cylindrical portion having a threaded portion 8 for installation into a buffer tube receiving aperture 11 of a lower receiver 10. Typically, an endplate 6 and a lock ring 4 are utilized to complete installation of the buffer tube 5 on the receiver. A key protrusion 7 extends from the cylindrical portion 9, typically at the 6 o'clock position. An interior portion of the key protrusion includes a plurality of spaced apart recesses or apertures that interact with a retractable bolt to lock the buttstock 2 in a desired position relative to the buffer tube 5.

During normal operation of a semiautomatic AR-15 style rifle, when a round is fired, gas from the burning propellant forces the bullet through the barrel. Before the bullet leaves the barrel, a portion of the gas enters a gas port in the upper part of the barrel under the front sight (or gas block). The gas port directs gas through a portion of the front sight (or gas block) and into the gas tube, which directs the gas into a cylinder between the bolt carrier 13 and the bolt and drives the bolt carrier 13 rearward.

The buffer, which is pushing on the rear of the bolt carrier group, is forced rearward by the bolt carrier group, compressing the recoil spring. During this rearward movement, a cam track in the upper portion of the bolt carrier 13 acts on the bolt cam pin, rotating the cam pin and bolt clockwise so that the bolt locking lugs are unlocked from the barrel extension locking lugs. As the rearward movement of the bolt carrier group continues, the empty cartridge case is extracted from the chamber, and ejected through the ejection port.

As the bolt carrier group clears the top of an inserted magazine and the empty cartridge case is expelled, a new round is pushed into the path of the bolt by the upward thrust of the magazine follower and spring.

As the bolt carrier group continues to move rearward, it overrides the hammer and forces the hammer down into the receiver, compressing the hammer spring, and allowing the rear hook of the hammer to engage with the hammer disconnect.

When the bolt carrier group reaches its rearmost position (when the rear of the buffer contacts the bottom wall at the rear of the buffer tube 5), the compressed recoil spring expands, driving the buffer assembly forward with enough force to drive the bolt carrier group forward, toward the chamber, initiating chambering of the waiting round from the magazine into the chamber.

The forward movement of the bolt ceases when the locking lugs pass between the barrel extension locking lugs and the round is fully chambered. When the bolt carrier 13 enters the final portion of its forward movement, the bolt cam pin emerges from the cam pin guide channel in the upper receiver and moves along the cam track, rotating the bolt counterclockwise. This rotation locks the bolt to the barrel extension (by interaction of the bolt locking lugs and the barrel extension locking lugs). The locking of the bolt completes the cycle of operation and, when the trigger is released, the rear hammer hook hammer slips from the disconnect and the front hammer hook is caught by the sear of the trigger. The firearm is then ready to be fired again.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Unfortunately, the typical buffer tube 5 must be relatively lengthy to accommodate the recoil spring, the buffer, and a rear portion of the bolt carrier 13 (during the firing cycle). This results in a buffer tube 5 that is relatively lengthy, heavy, and cumbersome.

Additionally, attempts to produce compact buffer tube assemblies rely on a design that incorporates the bolt carrier and the buffer into a combined assembly. This single unit design does not allow the user to "shotgun" the upper and requires that the user incorporate a proprietary bolt carrier.

Furthermore, known buffers do not take advantage of the weight of the buffer body as part of the dead blow reciprocating mass. Thus, mass of the known buffer is wasted.

The disadvantages and shortcomings of the prior art are overcome by the features and elements of the compact recoil management system of the present disclosure. The advantages of the present disclosure are preferably attained by providing, in an exemplary, nonlimiting embodiment, a compact recoil management system, comprising a receiver extension or buffer tube having an internal buffer tube cavity; an external recoil spring positioned within the internal buffer tube cavity; a buffer, wherein a buffer extension portion extends rearward from the first end to a first buffer shoulder, wherein a buffer body portion extends rearward from the first buffer shoulder to a second buffer shoulder, wherein the buffer body portion has a larger outer diameter or size than an outer diameter or size of the buffer extension portion, wherein a buffer head portion extends rearward from the second buffer shoulder to the second end of the buffer, and wherein the buffer head portion has a larger outer diameter or size than an outer diameter or size of the buffer body portion; an end cap attached or coupled to the buffer, such that the end cap extends from the buffer head portion of the buffer; a spacer having a spacer aperture formed through the spacer, wherein a spacer recess extends from a first end of the spacer and is defined by one or more side walls and a spacer recess shoulder, wherein the spacer recess is formed so as to accept at least a portion of the buffer head therein, wherein the spacer aperture has a diameter that is less than a diameter of the spacer recess, wherein the spacer is slidable along at least a portion of the buffer body portion, and wherein an outer diameter or size of the spacer is such that the spacer is slidable within the internal cavity of the buffer tube; an internal recoil spring, wherein the internal recoil spring has an external diameter that is less than an internal diameter of the external recoil spring, and wherein the internal recoil spring is positioned along at least a portion of the buffer body portion, between the buffer head portion and the spacer; and a buffer head, wherein a buffer head aperture is formed through the buffer head, wherein the buffer head is attached or coupled to the buffer extension portion.

In still other exemplary, nonlimiting embodiments, a compact recoil management system is provided that comprises a buffer tube, wherein the buffer tube comprises an elongate portion of material extending, along a longitudinal axis, from a first end to a second end and having an internal buffer tube cavity defined by an open end, one or more side walls, and a bottom wall; an external recoil spring, wherein the external recoil spring extends from a first end to a second end; an internal recoil spring, wherein the internal recoil spring extends from a first end to a second end, and wherein the internal recoil spring has an external diameter that is less than an internal diameter of the external recoil spring; a buffer, wherein the buffer comprises an elongate portion of material extending, along a longitudinal axis, from a first end to a second end and having an internal buffer cavity defined by an open end, one or more side walls, and a bottom wall, wherein a buffer extension portion extends rearward from the first end to a first buffer shoulder, wherein a buffer body portion extends rearward from the first buffer shoulder to a second buffer shoulder, wherein the buffer body portion has a larger outer diameter or size than an outer diameter or size of the buffer extension portion, wherein a buffer head portion extends rearward from the second buffer shoulder to the second end of the buffer, and wherein the buffer head portion has a larger outer diameter or size than an outer diameter or size of the buffer body portion; an end cap, wherein the end cap extends, along a longitudinal axis, from a first end to a second end, wherein an end cap extension portion extends rearward from the first end of the end cap to an end cap shoulder, wherein an outer size and shape of the end cap extension portion is such that at least a portion of the end cap extension portion can be fitted through the open end of the buffer cavity and positioned within at least a portion of the buffer cavity, wherein an end cap head portion extends rearward from the end cap shoulder to the second end of the end cap, and wherein the end cap head portion has a larger outer diameter or size than an outer diameter or size of the end cap extension portion; a spacer, wherein the spacer extends, along a longitudinal axis, from a first end to a second end, wherein a spacer aperture is formed through the spacer, along the longitudinal axis, wherein a spacer recess extends from the first end of the spacer and is defined by one or more side walls and a spacer recess shoulder, wherein the spacer recess is formed so as to accept at least a portion of the buffer head therein, wherein the spacer aperture has a diameter that is less than a diameter of the spacer recess, and wherein an outer diameter or size of the spacer is such that the spacer fits within and is slidable within the internal cavity of the buffer tube; and a buffer head, wherein the buffer head comprises a buffer head body that extends, along a longitudinal axis, from a first end to a second end, wherein a buffer head aperture is formed through the buffer head, along the longitudinal axis, wherein the buffer head aperture is formed so as to accept at least a portion of the buffer extension portion therein, wherein the buffer head body is formed so as to be at least partially received within at least a portion of the spacer recess.

Accordingly, the presently disclosed systems, methods, and/or apparatuses provide a compact recoil management system that allows for the use of a shortened, more compact buffer tube.

The presently disclosed systems, methods, and/or apparatuses separately provide a compact recoil management system that utilizes at least an external recoil spring and an internal recoil spring.

The presently disclosed systems, methods, and/or apparatuses separately provide a compact recoil management system that provides recoil management with a buffer requiring a shorter distance of travel.

The presently disclosed systems, methods, and/or apparatuses separately provide a compact recoil management system that can be utilized in conjunction with a standard bolt carrier.

The presently disclosed systems, methods, and/or apparatuses separately provide a compact recoil management system that allows the user to "shotgun" the upper receiver.

The presently disclosed systems, methods, and/or apparatuses separately provide a compact recoil management system that utilizes various components of the buffer assembly as part of a reciprocating mass.

The presently disclosed systems, methods, and/or apparatuses separately provide a compact recoil management system that provides and "dead below" effect.

The presently disclosed systems, methods, and/or apparatuses separately provide a compact recoil management system that allows a rifle operating system to be "tuned".

The presently disclosed systems, methods, and/or apparatuses separately provide a compact recoil management system that can be easily assembled and/or retrofitted by a user.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE INVENTION

Figure 1:
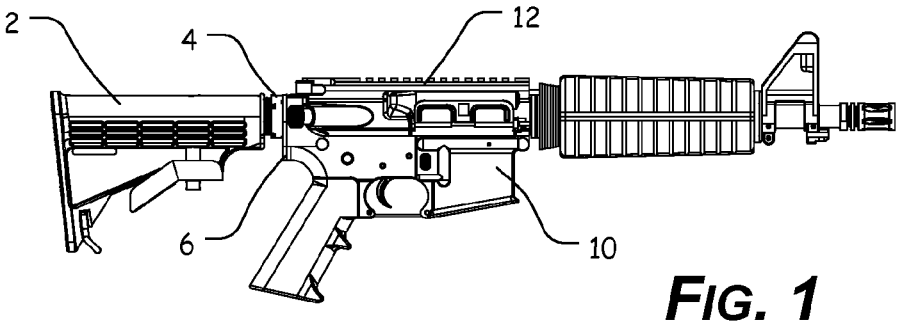
FIG. 1 PRIOR ART
FIG. 1 illustrates a side view of a standard, AR-15 or M4 style rifle having a collapsible buttstock, shown in a collapsed position relative to a standard buffer tube.
Figure 2:
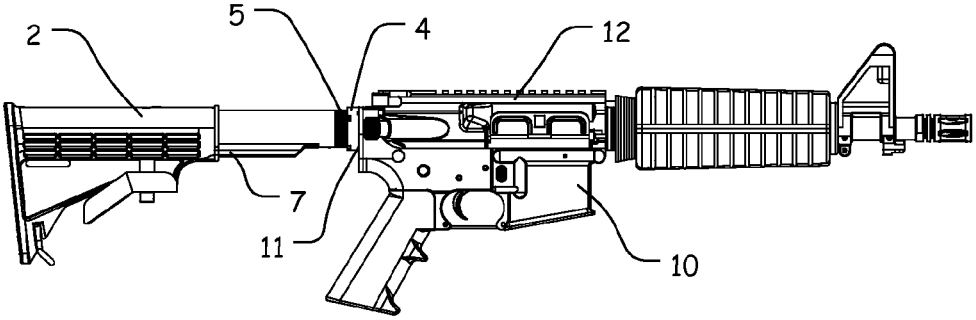
FIG. 2 PRIOR ART
FIG. 2 illustrates a side view of a standard, AR-15 or M4 style rifle having a collapsible buttstock, shown in an extended position relative to a standard buffer tube.
Figure 3:
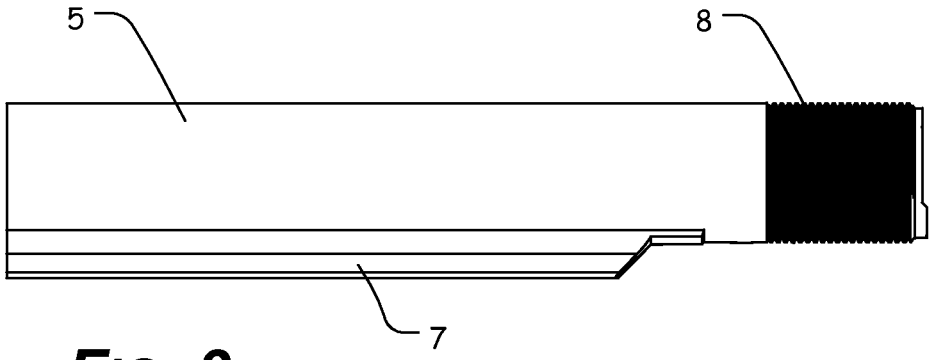
FIG. 3 PRIOR ART
FIG. 3 illustrates a side view of a standard buffer tube.
Figure 4:
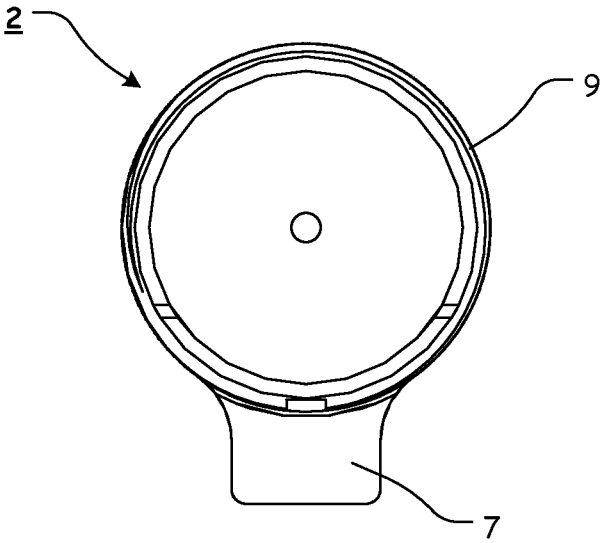
FIG. 4 PRIOR ART
FIG. 4 illustrates a front view of a standard buffer tube.
Figure 5:
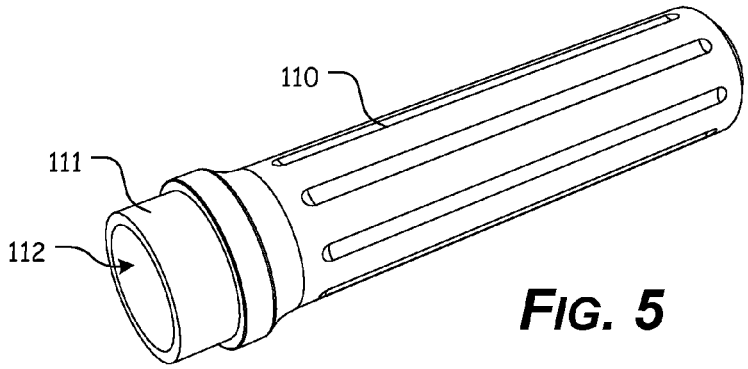
FIG. 5 illustrates an upper, front perspective view of an exemplary embodiment of a compact buffer tube, according to the presently disclosed systems, methods, and/or apparatuses.
Figure 6:
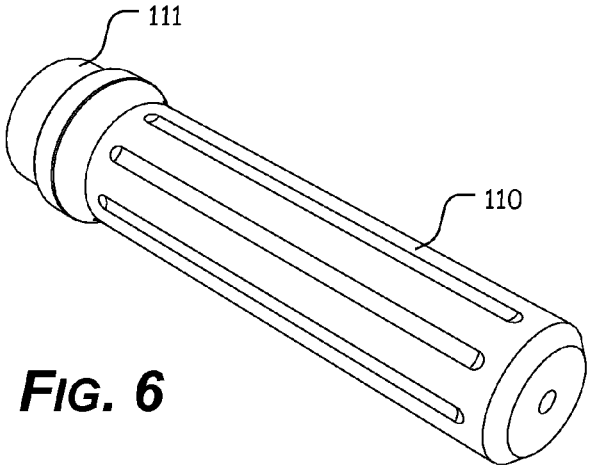
FIG. 6 illustrates an upper, rear perspective view of an exemplary embodiment of a compact buffer tube, according to the presently disclosed systems, methods, and/or apparatuses.
Figure 7:
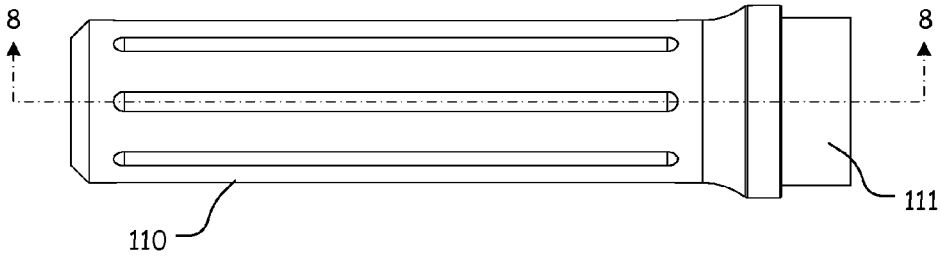
FIG. 7 illustrates a side view of an exemplary embodiment of a compact buffer tube, according to the presently disclosed systems, methods, and/or apparatuses.
Figure 8:
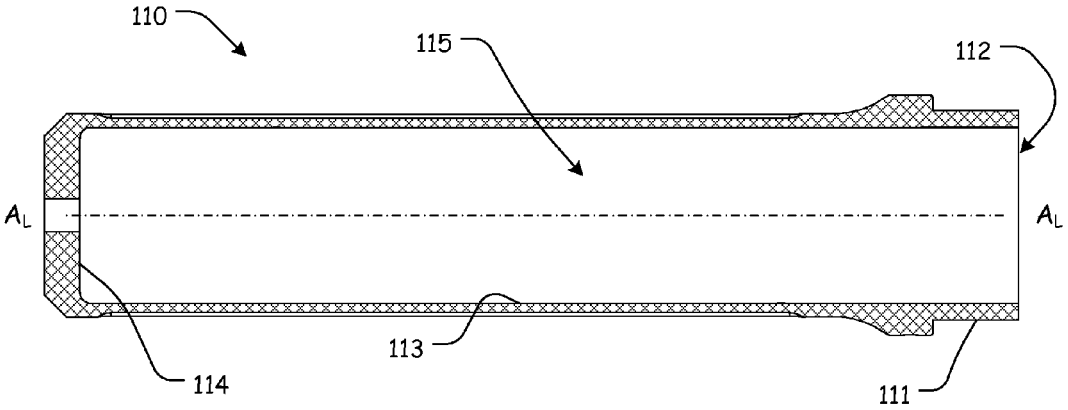
FIG. 8 illustrates a side cross-sectional view taken along line 8-8 of the compact buffer tube of FIG. 7, according to the presently disclosed systems, methods, and/or apparatuses.
Figure 9:
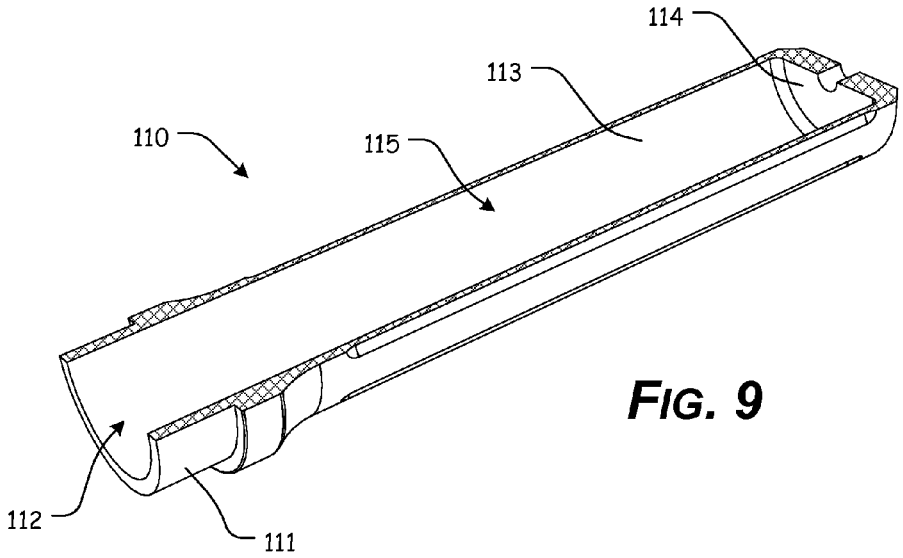
FIG. 9 illustrates a perspective cross-sectional view taken along line 8-8 of the compact buffer tube of FIG. 7, according to the presently disclosed systems, methods, and/or apparatuses.
Figure 10:
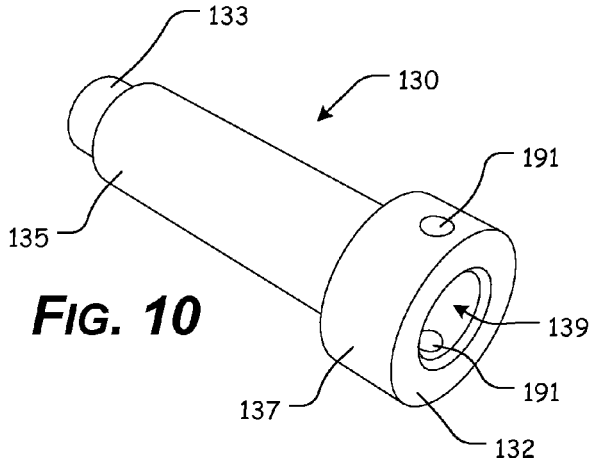
FIG. 10 illustrates an upper, rear perspective view of an exemplary embodiment of a buffer, according to the presently disclosed systems, methods, and/or apparatuses.
Figure 11:
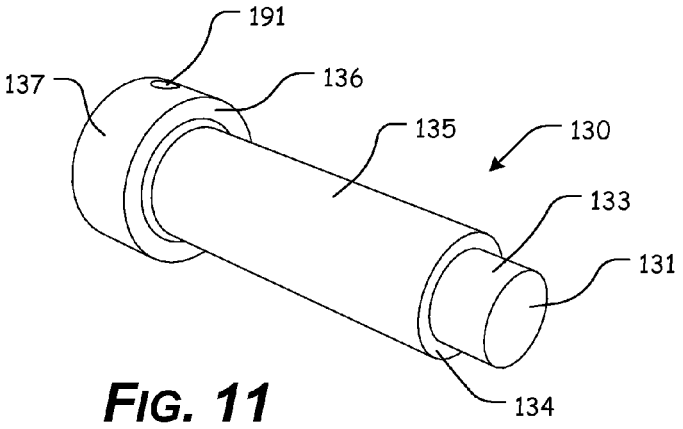
FIG. 11 illustrates an upper, front perspective view of an exemplary embodiment of a buffer, according to the presently disclosed systems, methods, and/or apparatuses.
Figure 12:
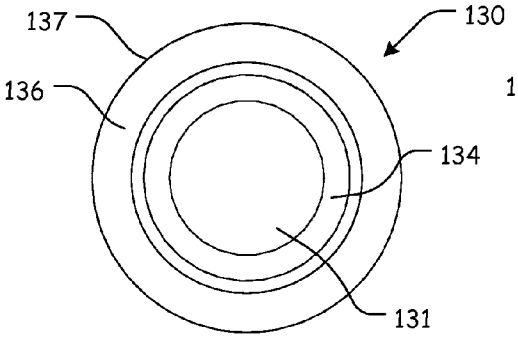
FIG. 12 illustrates a front view of an exemplary embodiment of a buffer, according to the presently disclosed systems, methods, and/or apparatuses.
Figure 13:
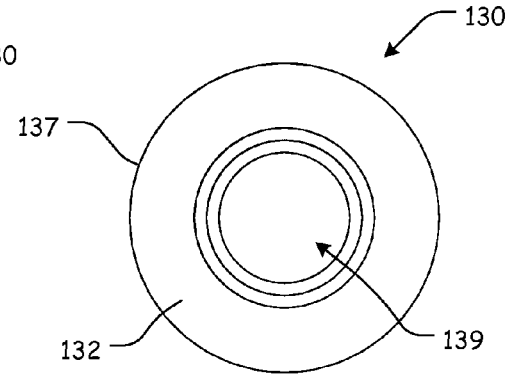
FIG. 13 illustrates a rear view of an exemplary embodiment of a buffer, according to the presently disclosed systems, methods, and/or apparatuses.
Figure 14:
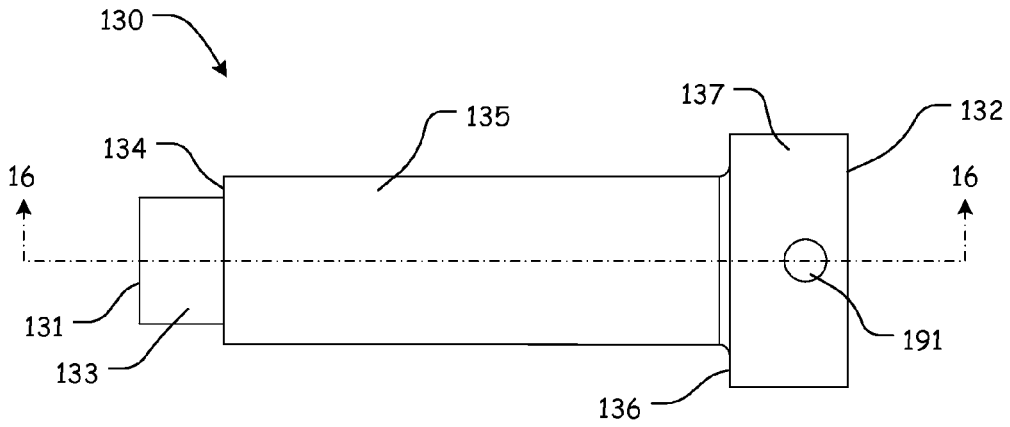
FIG. 14 illustrates a top view of an exemplary embodiment of a buffer, according to the presently disclosed systems, methods, and/or apparatuses.
Figure 15:
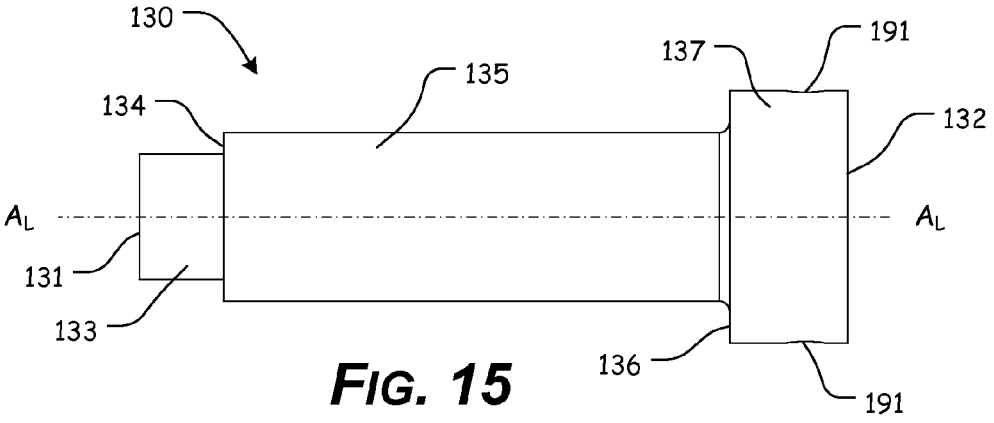
FIG. 15 illustrates a side view of an exemplary embodiment of a buffer, according to the presently disclosed systems, methods, and/or apparatuses.
Figure 16:
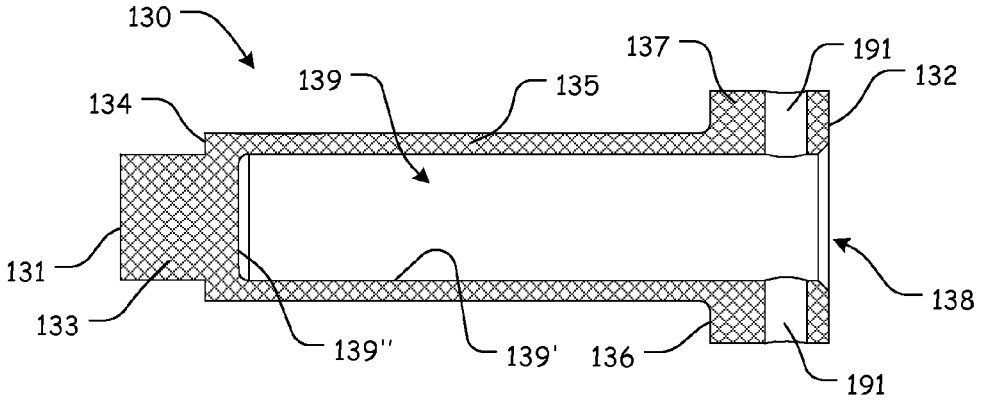
FIG. 16 illustrates a cross-sectional view taken along line 16-16 of the buffer tube of FIG. 14, according to the presently disclosed systems, methods, and/or apparatuses.
Figure 17:
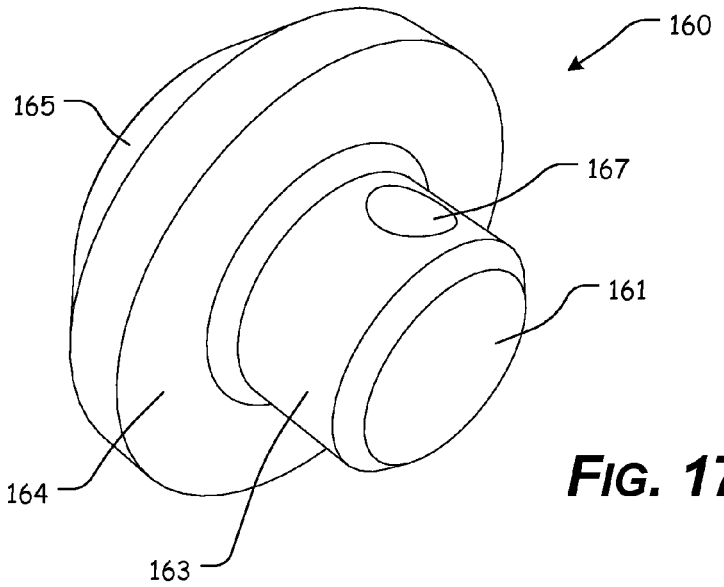
FIG. 17 illustrates an upper, front perspective view of an exemplary embodiment of an end cap, according to the presently disclosed systems, methods, and/or apparatuses.
Figure 18:
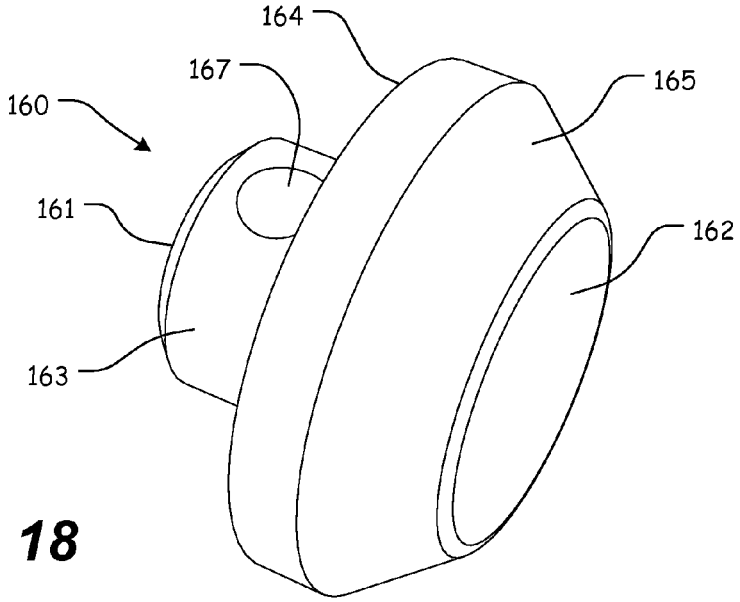
FIG. 18 illustrates an upper, rear perspective view of an exemplary embodiment of an end cap, according to the presently disclosed systems, methods, and/or apparatuses.
Figure 19:
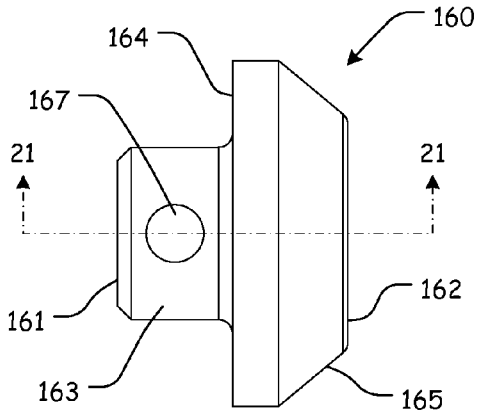
FIG. 19 illustrates a top view of an exemplary embodiment of an end cap, according to the presently disclosed systems, methods, and/or apparatuses.
Figure 20:
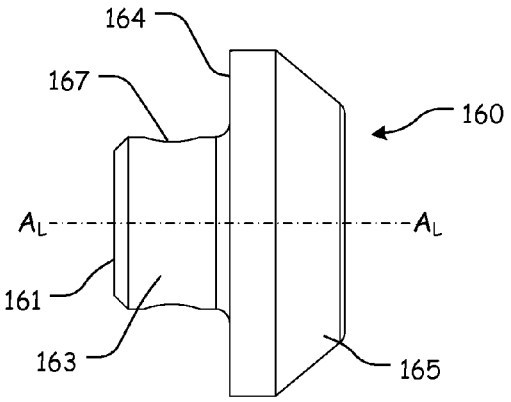
FIG. 20 illustrates a side view of an exemplary embodiment of an end cap, according to the presently disclosed systems, methods, and/or apparatuses.
Figure 21:
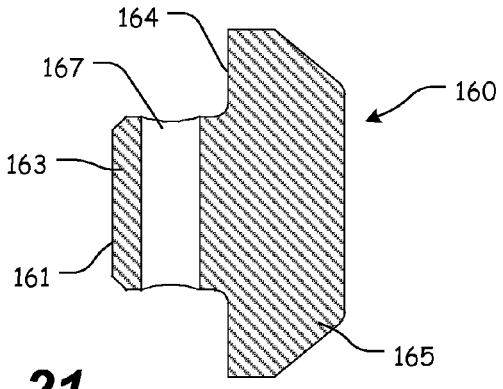
FIG. 21 illustrates a cross-sectional view taken along line 21-21 of the end cap of FIG. 19, according to the presently disclosed systems, methods, and/or apparatuses.
Figure 22:
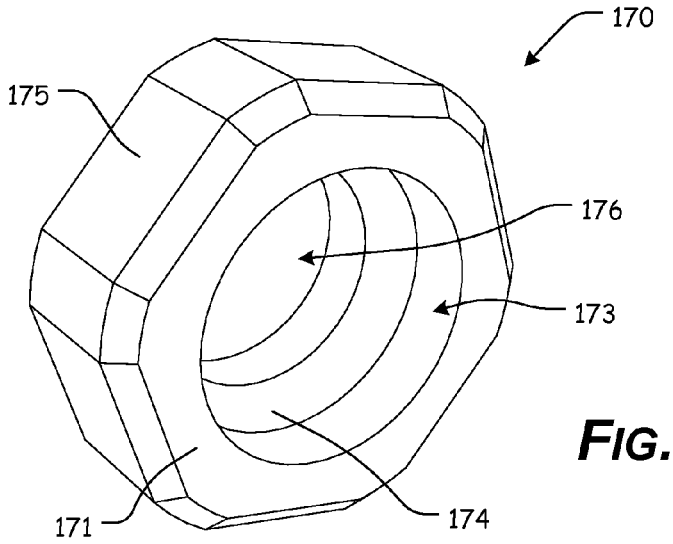
FIG. 22 illustrates an upper, front perspective view of an exemplary embodiment of a spacer, according to the presently disclosed systems, methods, and/or apparatuses.
Figure 23:
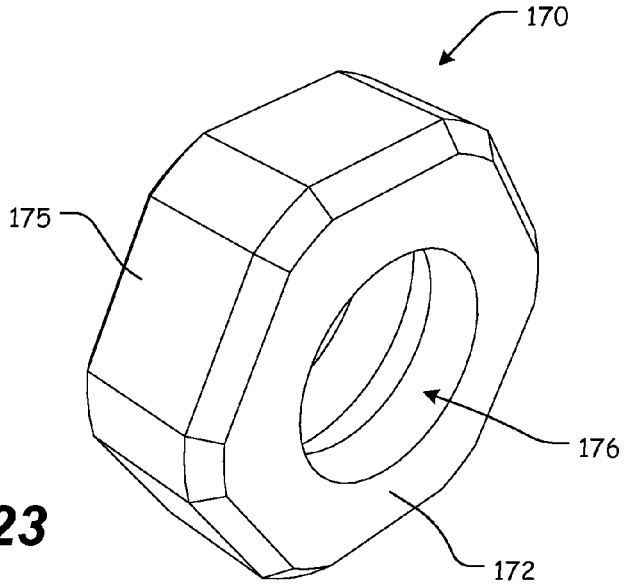
FIG. 23 illustrates an upper, rear perspective view of an exemplary embodiment of a spacer, according to the presently disclosed systems, methods, and/or apparatuses.
Figure 24:
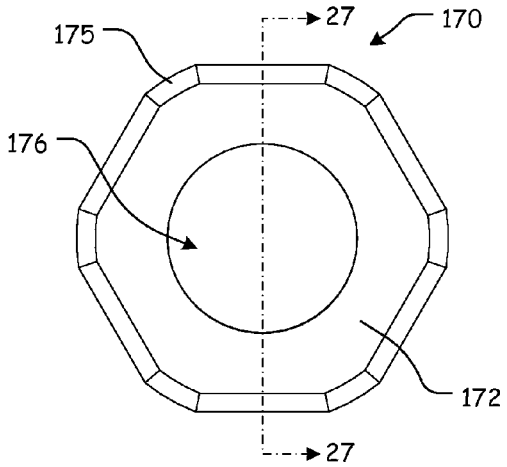
FIG. 24 illustrates a rear view of an exemplary embodiment of a spacer, according to the presently disclosed systems, methods, and/or apparatuses.
Figure 25:
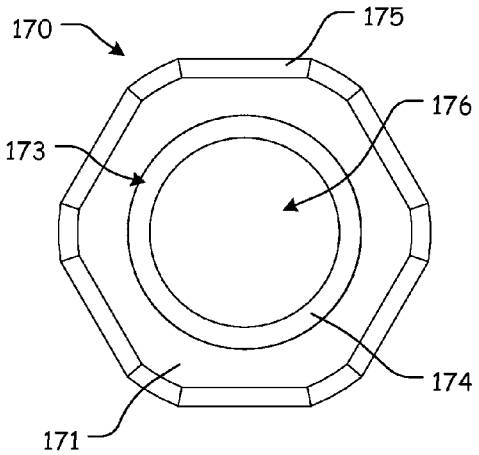
FIG. 25 illustrates a front view of an exemplary embodiment of a spacer, according to the presently disclosed systems, methods, and/or apparatuses.
Figure 26:
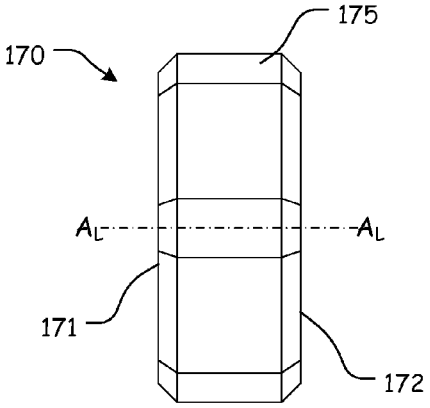
FIG. 26 illustrates a side view of an exemplary embodiment of a spacer, according to the presently disclosed systems, methods, and/or apparatuses.
Figure 27:
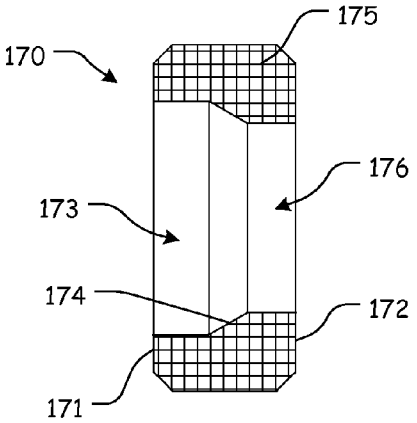
FIG. 27 illustrates a cross-sectional view taken along line 27-27 of the spacer of FIG. 24, according to the presently disclosed systems, methods, and/or apparatuses.
Figure 28:
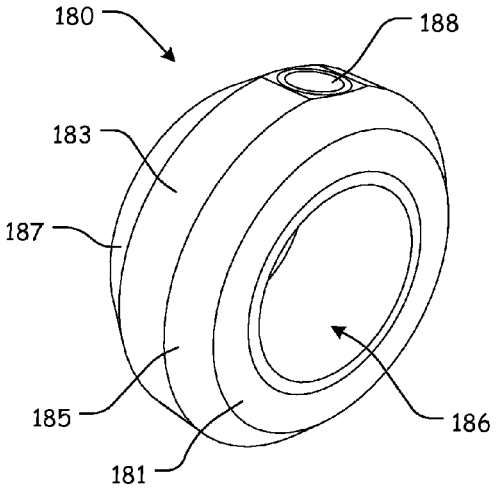
FIG. 28 illustrates an upper, front perspective view of an exemplary embodiment of a buffer head, according to the presently disclosed systems, methods, and/or apparatuses.
Figure 29:
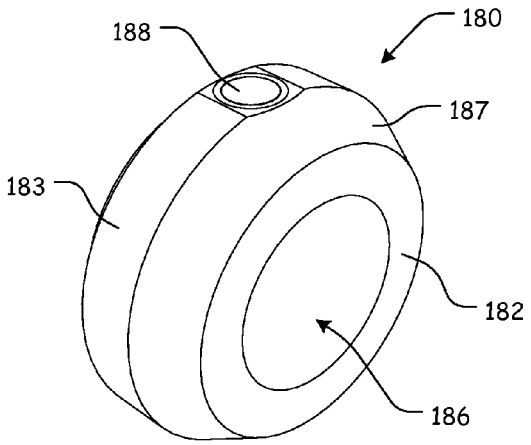
FIG. 29 illustrates an upper, rear perspective view of an exemplary embodiment of a buffer head, according to the presently disclosed systems, methods, and/or apparatuses.
Figure 30:
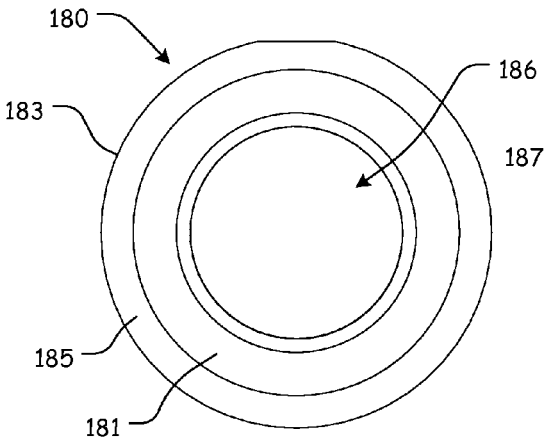
FIG. 30 illustrates a front view of an exemplary embodiment of a buffer head, according to the presently disclosed systems, methods, and/or apparatuses.
Figure 31:
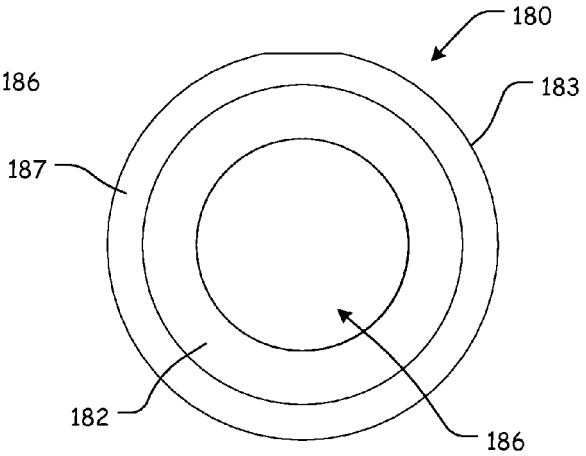
FIG. 31 illustrates a rear view of an exemplary embodiment of a buffer head, according to the presently disclosed systems, methods, and/or apparatuses.
Figure 32:
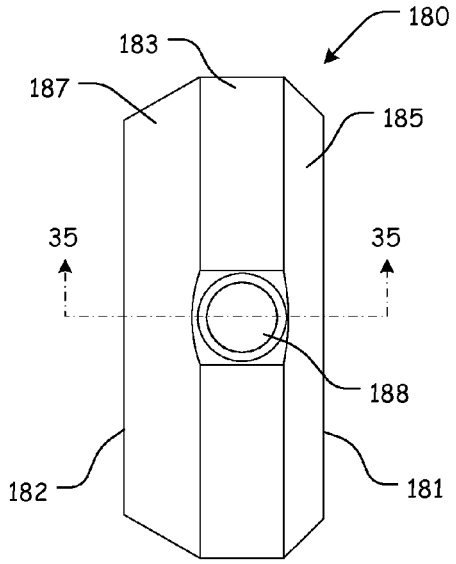
FIG. 32 illustrates a top view of an exemplary embodiment of a buffer head, according to the presently disclosed systems, methods, and/or apparatuses.
Figure 33:
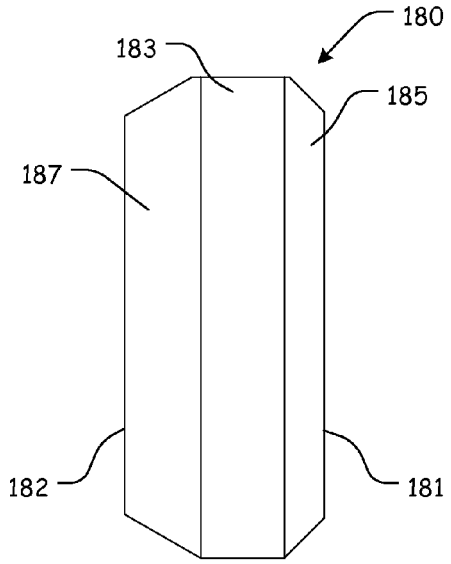
FIG. 33 illustrates a right side view of an exemplary embodiment of a buffer head, according to the presently disclosed systems, methods, and/or apparatuses.
Figure 34:
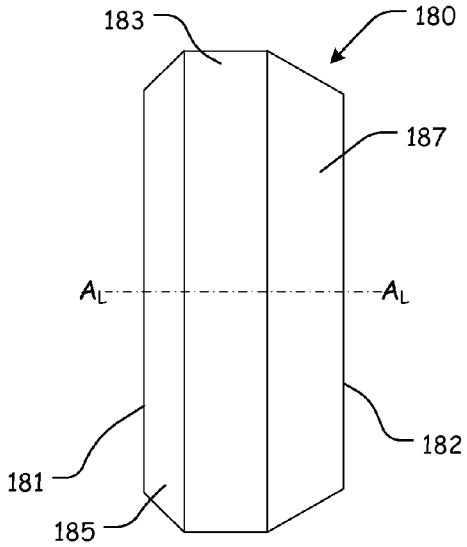
FIG. 34 illustrates a left side view of an exemplary embodiment of a buffer head, according to the presently disclosed systems, methods, and/or apparatuses.
Figure 35:
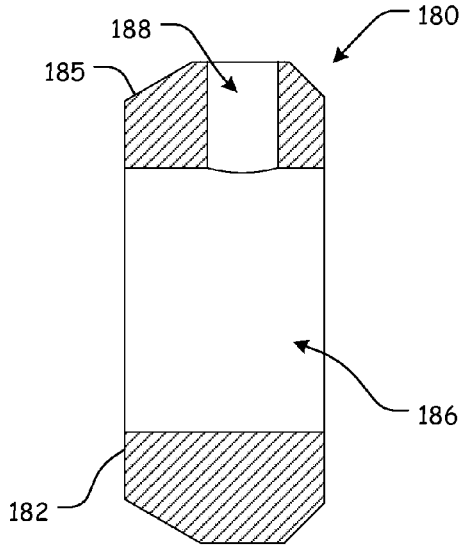
FIG. 35 illustrates a cross-sectional view taken along line 35-35 of the buffer head of FIG. 32, according to the presently disclosed systems, methods, and/or apparatuses.
Figure 36:
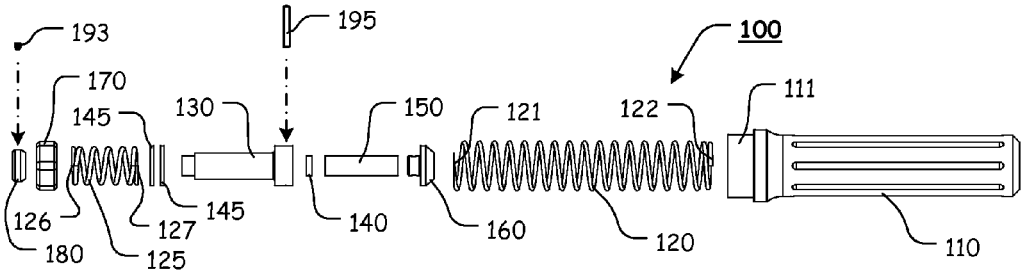
FIG. 36 illustrates an left side, exploded view of certain exemplary components of an exemplary embodiment of a compact recoil management system, according to the presently disclosed systems, methods, and/or apparatuses.
Figure 37:
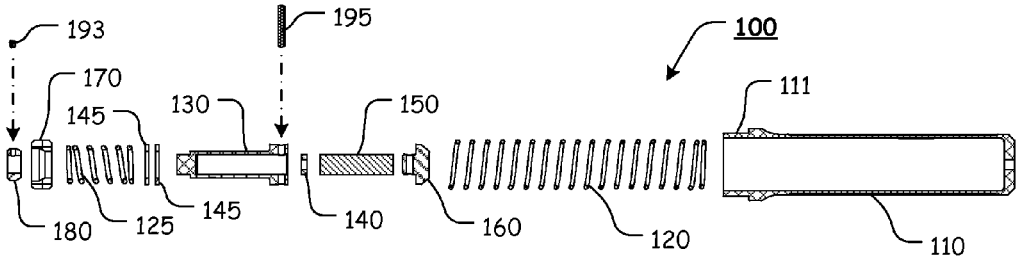
FIG. 37 illustrates an left side, cross-sectional, exploded view of certain exemplary components of an exemplary embodiment of a compact recoil management system of FIG. 36, according to the presently disclosed systems, methods, and/or apparatuses.

For simplicity and clarification, the design factors and operating principles of the compact recoil management system according to the presently disclosed systems, methods, and/or apparatuses are explained with reference to various exemplary embodiments of a compact recoil management system according to the presently disclosed systems, methods, and/or apparatuses. The basic explanation of the design factors and operating principles of the compact recoil management system is applicable for the understanding, design, and operation of the compact recoil management system of the presently disclosed systems, methods, and/or apparatuses. It should be appreciated that the compact recoil management system can be adapted to many applications where a compact recoil management system or strap can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "compact recoil management system", "buffer assembly", "lower receiver", and "firearm" are used for basic explanation and understanding of the operation of the presently disclosed systems, methods, and/or apparatuses. Therefore, the terms "compact recoil management system", "buffer assembly", "lower receiver", and "firearm" are not to be construed as limiting the systems, methods, and/or apparatuses of the present disclosure. Thus, for example, the term "lower receiver" is to be understood to broadly include any upper, lower, or combined receiver for a firearm or other similar handheld or shoulder mounted device or tool.

For simplicity and clarification, the compact recoil management system of the present disclosure will be described as being used in conjunction with a firearm, such as an AR-15 or M4 style rifle or carbine. However, it should be appreciated that these are merely exemplary embodiments of the compact recoil management system and are not to be construed as limiting the presently disclosed systems, methods, and/or apparatuses. Thus, the compact recoil management system of the present disclosure may be utilized in conjunction with any firearm or rifle, such as, for example, an AR-10 style rifle, air rifle, paintball marker, Airsoft rifle, replica rifle, or any other tool, device, or object.

Turning now to the drawing FIGS., as discussed above, FIG. 1-4 illustrate various components of known buffer tubes. FIGS. 5-42 illustrate certain elements and/or aspects of an exemplary embodiment of the compact recoil management system 100, according to the presently disclosed systems, methods, and/or apparatuses. In illustrative, non-limiting embodiment(s) of the present disclosure, as illustrated in FIGS. 5-42, the compact recoil management system 100 comprises at least some of a receiver extension or buffer tube 110, an external recoil spring 120, an internal recoil spring 125, a buffer 130, an internal washer 140, one or more external washers 145, a weight 150, an end cap 160, a spacer 170, and a buffer head 180.

As illustrated most clearly in FIGS. 5-9, the receiver extension or buffer tube 110 comprises an elongate portion of material extending, along a longitudinal axis $A_L$, from a first end to a second end and having a substantially cylindrical internal cavity 115 defined by one or more side walls 113 and a bottom wall 114. The internal cavity 115 extends from the bottom wall 114, along the one or more side walls 113, to an open end 112.

In various exemplary embodiments, the buffer tube 110 includes an externally threaded portion 111, which extends from the first end. The externally threaded portion 111, if included, allows the buffer tube 110 to be threadedly attached or connected to the lower receiver 10, via interaction of the externally threaded portion 111 of the buffer tube 110 and an internally threaded buffer tube receiving aperture 11 of the lower receiver 10.

Alternatively, the portion of the buffer tube 110 represented by the externally threaded portion 111 may comprise a smooth or textured surface that allows the buffer tube 110 to be welded or adhesively attached or coupled to a corresponding buffer tube receiving aperture of a lower receiver. Thus, the buffer tube 110 may be attached, connected, or coupled to a lower receiver in any desired manner. In still other exemplary embodiments, the buffer tube 110 may be formed as an integral component of a lower receiver.

The overall length of the buffer tube 110 is substantially shorter than a known, typical buffer tube 5. Thus, the buffer tube 110 can be utilized in conjunction with, for example, retractable buttstocks that provide a shorter overall length to the buttstock assembly and/or firearm. Alternatively, the buffer tube 110 can be utilized in conjunction with certain pistol configurations to provide a shorter overall length to the firearm.

In various exemplary embodiments, the buffer tube 110 is substantially rigid and is formed of aluminum. Alternate materials of construction of the buffer tube 110 may include one or more of the following: steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the buffer tube 110 is a design choice based on the desired appearance and/or functionality of the buffer tube 110.

The external recoil spring 120 extends from a first end 121 to a second end 122. In various exemplary embodiments, the external recoil spring 120 comprises a standard AR buffer spring, having a reduced length. In certain exemplary, nonlimiting embodiments, the external recoil spring 120 comprises a standard AR buffer spring that has been shortened.

The internal recoil spring 125 extends from a first end to a second end. The internal recoil spring 125 has an external diameter that is less than an internal diameter of the external recoil spring 120. In this manner, when assembled, the internal recoil spring 125 can be fitted within the external recoil spring 120.

In various exemplary embodiments, the internal recoil spring 125 may optionally have a spring rate or spring biasing force that is less than a spring rate or spring biasing force of the external recoil spring 120. In other exemplary embodiments, the internal recoil spring 125 may optionally have a spring rate or spring biasing force that is greater than a spring rate or spring biasing force of the external recoil spring 120. In still other exemplary embodiments, the internal recoil spring 125 may optionally have a spring rate or spring biasing force that is equal to a spring rate or spring biasing force of the external recoil spring 120. Thus, it should be appreciated that the spring rates or spring biasing forces of the internal recoil spring 125 and the external recoil spring 120 may be the same or may be different from one another.

It should be appreciated that the overall size and characteristics of the external recoil spring 120 and the internal recoil spring 125 are designed choices based upon the desired performance of the external recoil spring 120 and the internal recoil spring 125. Additionally, the external recoil spring 120 and the internal recoil spring 125 may be formed of steel, spring-tempered steel, brass, phosphor bronze, or any other desired material.

In certain exemplary embodiments, the combined spring rate or spring biasing force of the external recoil spring 120 and the internal recoil spring 125 is approximately equivalent to the spring biasing force of a standard, MIL-SPEC carbine buffer spring rate or spring biasing force.

It should be appreciated that the terms "internal", as used in reference to the "internal recoil spring" and "external", as used in reference to the "external recoil spring", are used for basic explanation and understanding of the operation of the presently disclosed systems, methods, and/or apparatuses. Therefore, the terms "internal" and "external" are to be seen as a naming convention used to help differentiate between certain of the components of the compact recoil management system 100 and are not to be construed as limiting the systems, methods, and/or apparatuses of the present disclosure.

As illustrated most clearly in FIGS. 10-16, the buffer 130 comprises an elongate portion of material extending, along a longitudinal axis $A_L$, from a first end 131 to a second end 132.

In various exemplary, nonlimiting embodiments, the buffer 130 is formed of a solid portion of Stainless Steel does not include an internal buffer cavity 139. In these exemplary, nonlimiting embodiments, the manufacturing time and cost of the buffer 130 reduced. Furthermore, the solid steel buffer 130 provide sufficient weigh to be close to the reciprocating mass of a standard, MIL-SPEC carbine buffer.

In various exemplary embodiments, the buffer 130 includes an internal buffer cavity 139 defined by one or more side walls 139' and a bottom wall 139". The internal buffer cavity 139 extends from the bottom wall 139", along the one or more side walls 139', to an open end 138.

In various exemplary embodiments, a buffer extension portion 133 extends rearward from the first end 131. The buffer extension portion 133 extends from the first end 131 to a first buffer shoulder 134. In various exemplary embodiments, the buffer extension portion 133 extends parallel to the longitudinal axis $A_L$, of the buffer 130 and the first buffer shoulder 134 extends perpendicular to the longitudinal axis $A_L$, of the buffer 130. Alternatively, the first buffer shoulder 134 may extend at an angle that is equal to, greater than, or less than 90° relative to the longitudinal axis $A_L$, of the buffer 130.

A buffer body portion 135 extends rearward from the first buffer shoulder 134 to a second buffer shoulder 136. In various exemplary embodiments, the buffer body portion 135 extends parallel to the longitudinal axis $A_L$, of the buffer 130 and the second buffer shoulder 136 extends perpendicular to the longitudinal axis $A_L$, of the buffer 130. Alternatively, the second buffer shoulder 136 may extend at an angle that is equal to, greater than, or less than 90° relative to the longitudinal axis $A_L$, of the buffer 130.

In various exemplary embodiments, the buffer body portion 135 has a larger outer diameter or size than an outer diameter or size of the buffer extension portion 133. Thus, the first buffer shoulder 134 provides a transition between the buffer body portion 135 and the buffer extension portion 133.

A buffer head portion 137 extends rearward from the second buffer shoulder 136 to the second end 132. In various exemplary embodiments, the buffer head portion 137 extends parallel to the longitudinal axis $A_L$, of the buffer 130.

In various exemplary embodiments, the buffer head portion 137 has a larger outer diameter or size than an outer diameter or size of the buffer body portion 135. Thus, the second buffer shoulder 136 provides a transition between the buffer head portion 137 and the buffer body portion 135.

A buffer retaining pin aperture 191 extends at least partially through the buffer head portion 137 and is formed so as to accept at least a portion of a retaining pin 195 therethrough.

In various exemplary embodiments, the buffer 130 is substantially rigid and is formed of aluminum. Alternate materials of construction of the buffer 130 may include one or more of the following: steel, stainless steel, titanium, and/or other metals, as well as various alloys and composites thereof. Thus, it should be understood that the material or materials used to form the buffer 130 is a design choice based on the desired appearance and/or functionality of the buffer 130.

The internal washer 140, if included, has an outer diameter that allows the internal washer 140 to be fitted within the internal buffer cavity 139 of the buffer 130. In various exemplary embodiments, the internal washer 140, if included, acts as a cushion between the bottom wall 139" of the internal buffer cavity 139 and the weight 150.

The one or more external washers 145, if included, each have an inner diameter that allows the external washers 145 to be slidably fitted about the buffer body portion 135, such that at least a portion of the buffer body portion 135 fits within the inner aperture of the external washers 145. Additionally, the outer diameter of each external washer 145 is approximately equal to an outer diameter or size of the buffer head portion 137 of the buffer 130. In this manner, when assembled, the external washers 145 do not extend beyond the buffer head portion 137.

The weight 150 is generally cylindrical in shape and is sized so as to be fitted within the internal buffer cavity 139 of the buffer 130. The actual weight of the weight 150 can vary, depending upon the desired functionality of the weight 150 and the overall functional weight of the buffer 130. In various exemplary embodiments, the wave may comprise a portion of stainless steel or tungsten rod.

As illustrated most clearly in FIGS. 16-21, the end cap 160 comprises a portion of material extending, along a longitudinal axis $A_L$, from a first end 161 to a second end 162. In various exemplary embodiments, an end cap extension portion 163 extends rearward from the first end 161. The end cap extension portion 163 extends from the first end 161 to an end cap shoulder 164. In various exemplary embodiments, the end cap extension portion 163 extends parallel to the longitudinal axis $A_L$, of the end cap 160 and the end cap shoulder 164 extends perpendicular to the longitudinal axis $A_L$, of the end cap 160. Alternatively, the end cap shoulder 164 may extend at an angle that is equal to, greater than, or less than 90° relative to the longitudinal axis $A_L$, of the end cap 160.

The outer size and shape of the end cap extension portion 163 is such that at least a portion of the end cap extension portion 163 can be fitted through the open end 138 of the buffer cavity 139 and positioned within at least a portion of the buffer cavity 139.

An end cap head portion 165 extends rearward from the end cap shoulder 164 to the second end 162. In various exemplary embodiments, the end cap head portion 165 has an overall dome or a tapered shape.

Alternatively, the end cap head portion 165 may comprise a generally cylindrical overall shape.

In various exemplary embodiments, the end cap head portion 165 has a larger outer diameter or size than an outer diameter or size of the end cap extension portion 163. Thus, the end cap shoulder 164 provides a transition between the end cap head portion 165 and the end cap extension portion 163.

An end cap retaining aperture 167 extends at least partially through the end cap extension portion 163 and is formed so as to accept at least a portion of a retaining pin 195 therethrough.

In various exemplary embodiments, the end cap 160 is substantially rigid and is formed of urethane. Alternatively, the end cap 160 may be substantially deformable or flexible and alternate materials of construction of the end cap 160 may include one or more of the following: rubber, silicone, plastic, self-lubricating plastic, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations or variations of the foregoing. Thus, it should be understood that the material or materials used to form the end cap 160 is a design choice based on the desired appearance and/or functionality of the end cap 160.

As illustrated most clearly in FIGS. 22-27, the spacer 170 comprises a portion of material extending, along a longitudinal axis $A_L$, from a first end 171 to a second end 172. A spacer aperture 176 is formed through the spacer 170, along the longitudinal axis $A_L$. A substantially cylindrical spacer recess 173 extends from the first end 171 and is defined by one or more side walls and a spacer recess shoulder 174. The spacer recess 173 is formed so as to accept at least a portion of the buffer head 180 therein.

In various exemplary embodiments, the spacer recess shoulder 174 extends perpendicular to the longitudinal axis $A_L$, of the spacer 170. Alternatively, as illustrated, the spacer recess shoulder 174 may extend at an angle that is greater than or less than 90° relative to the longitudinal axis $A_L$, of the spacer 170.

In various exemplary embodiments, the spacer aperture 176 has a diameter that is less than a diameter of the spacer recess 173.

In various exemplary embodiments, the overall profile of the spacer 170, when viewed from the front or rear, comprises a rounded hexagon. It should be appreciated that the overall profile of the spacer 170 may comprise for example, an overall profile resembling that of a circle, triangle, square, pentagon, hexagon, heptagon, octagon, star shape, or other desired shape.

Regardless of the overall shape or profile of the spacer 170, the outer diameter or extent of the spacer 170 is such that the spacer 170 fits within and is slidable within the internal cavity 115 of the buffer tube 110.

In various exemplary embodiments, the spacer 170 is substantially rigid and is formed of aluminum. Alternate materials of construction of the spacer 170 may include one or more of the following: steel, stainless steel, titanium, and/or other metals, as well as various alloys and composites thereof. Thus, it should be understood that the material or materials used to form the spacer 170 is a design choice based on the desired appearance and/or functionality of the spacer 170.

As illustrated most clearly in FIGS. 28-35, the buffer head 180 comprises a portion of material forming a buffer head body 183 that extends, along a longitudinal axis $A_L$, from a first end 181 to a second end 182. A buffer head aperture 186 is formed through the buffer head 180, along the longitudinal axis $A_L$. The buffer head aperture 186 is formed so as to accept at least a portion of the buffer extension portion 133 therein.

In various exemplary embodiments, the vertices of the first end 181 and the buffer head body 183 meet at a right angle, or 90°. Likewise, the vertices of the second end 182 and the buffer head body 183 meet at a right angle, or 90°.

In various exemplary embodiments, a first chamfer 185 is optionally formed as a transitional edge or plane between the first end 181 and the outer surface of the buffer head body 183. In certain exemplary embodiments, a second chamfer 187 is optionally formed as a transitional edge or plane between the second end 182 and the outer surface of the buffer head body 183.

It should be appreciated that the outer diameter and shape of the buffer head body 183 are formed so as to be at least partially received within at least a portion of the spacer recess 173 and the second chamfer 187 is formed so as to correspond with or mate with the spacer recess shoulder 174. Thus, if the spacer recess shoulder 174 is angled, the second chamfer 187 is present. Alternatively, if the spacer recess shoulder 174 is formed perpendicular to the longitudinal axis $A_L$, of the spacer 170, the second chamfer 187 is not present and the vertices of the second end 182 and the buffer head body 183 meet at a right angle, or 90°.

In various exemplary embodiments, the overall profile of the buffer head 180, when viewed from the front or rear, is substantially rounded. It should be appreciated that the overall profile of the buffer head 180 may be formed of any shape. Regardless of the overall shape or profile of the buffer head 180, the outer diameter or extent of the buffer head body 183 is such that at least a portion of the buffer head 180 or the buffer head body 183 fits within and is slidable within at least a portion of the spacer recess 173 of the spacer 170.

A head retaining pin aperture 188 extends at least from an outer surface of the buffer head body 183 into the buffer head aperture 186. In various exemplary embodiments, the head retaining pin aperture 188 is threaded and formed so as to accept at least a portion of a head retaining pin or set screw 193 therethrough.

In various exemplary embodiments, the buffer head 180 is substantially rigid and is formed of aluminum. Alternate materials of construction of the buffer head 180 may include one or more of the following: steel, stainless steel, titanium, and/or other metals, as well as various alloys and composites thereof. Thus, it should be understood that the material or materials used to form the buffer head 180 is a design choice based on the desired appearance and/or functionality of the buffer head 180.

As illustrated most clearly in FIGS. 36-42, the various components of the buffer assembly 100 are fitted together and the buffer tube 110 is attached or coupled to an exemplary lower receiver 10. As illustrated, during assembly, the external recoil spring 120 is inserted within the internal cavity 115 of the buffer tube 110. The external recoil spring 120 is inserted within the internal cavity 115 such that the second end 122 of the external recoil spring 120 is in contact with the bottom wall 114 of the internal cavity 115.

The internal washer 140, if included, is fitted within the internal buffer cavity 139 of the buffer 130 such that the internal washer 140 contacts the bottom wall 139" of the internal buffer cavity 139. The weight 150, if included, is then inserted within the internal buffer cavity 139. At least a portion of the end cap extension portion 163 is fitted through the open end 138 of the buffer cavity 139 and positioned within at least a portion of the buffer cavity 139, such that the end cap retaining aperture 167 is aligned with the buffer retaining pin aperture 191 and the end cap shoulder 164 optionally contacts the second end 132 of the buffer 130.

Once the end cap 160 is appropriately positioned proximate the second end 132 of the buffer 130, the retaining pin 195 is positioned through the buffer retaining pin aperture 191 and extends at least partially through the end cap retaining aperture 167. In certain exemplary embodiments, the retaining pin 195 is positioned through at least a portion of the buffer retaining pin aperture 191 on a first side of the buffer head portion 137, extends completely through the end cap retaining aperture 167, and extends through at least a portion of the buffer retaining pin aperture 191 on a second side of the buffer head portion 137.

The one or more external washers 145, if included, are slidably fitted about the buffer body portion 135, such that a first external washer 145 contacts the second buffer shoulder 136 of the buffer 130.

The internal recoil spring 125 is slidably fitted about the buffer body portion 135, such that the second end of the recoil spring 125 contacts an external washer 145, if included, or the second buffer shoulder 136 of the buffer 130 (if an external washer 145 is not included).

The spacer 170 is slidably fitted about the buffer body portion 135, via interaction of the spacer aperture 176 and the buffer body portion 135, such that the second end 172 of the spacer 170 contacts a first end of the recoil spring 125.

The buffer head 180 is slidably fitted about the buffer extension portion 133, via interaction of the buffer extension portion 133 and the buffer head aperture 186, such that second end 182 of the buffer head 180 contacts the first buffer shoulder 134 of the buffer 130.

Once the buffer head 180 is appropriately positioned proximate the first end 131 of the buffer 130, the head retaining set screw 193 is positioned through the head retaining pin aperture 188, such that at least a portion of a head retaining set screw 193 extends to contact at least an exterior surface of the buffer extension portion 133 to maintain frictional engagement between the buffer head 180 and the buffer 130.

When the buffer head 180 is attached or coupled to the buffer 130, the internal recoil spring 125 is captured between the second buffer shoulder 136 of the buffer 130 (or the external washers 145) and the second end 172 of the spacer 170. Because of the spring biasing force of the internal recoil spring 125, the spacer 170 is biased toward the first end 131 of the buffer 130 and at least a portion of the buffer head 180 or the buffer head body 183 fits within and is slidable within at least a portion of the spacer recess 173 of the spacer 170.

Once the relevant components are attached or coupled to the buffer 130, the assembled components are positioned within the external recoil spring 120 such that the first end 121 of the external recoil spring 120 engages or contacts the second end 172 of the spacer 170.

Figure 38:
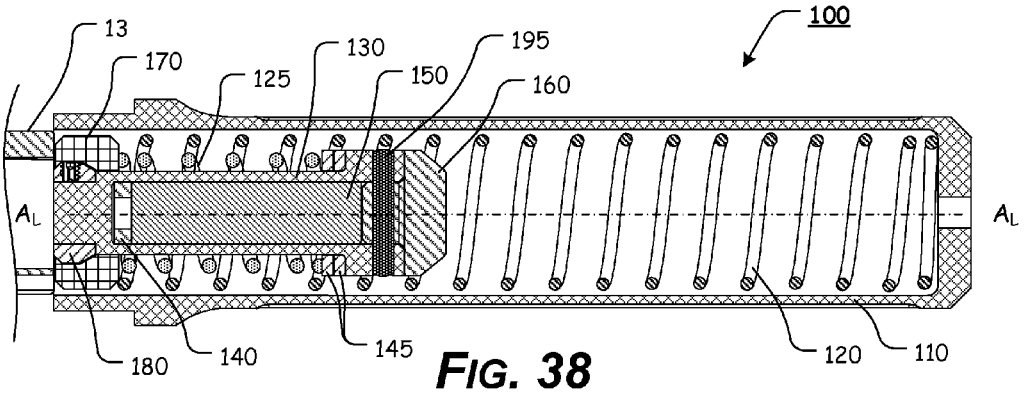
FIG. 38 illustrates an left side, cross-sectional view of certain exemplary components of an exemplary embodiment of a compact recoil management system, assembled according to the presently disclosed systems, methods, and/or apparatuses, wherein the components are in a normal, installed position.
Figure 39:
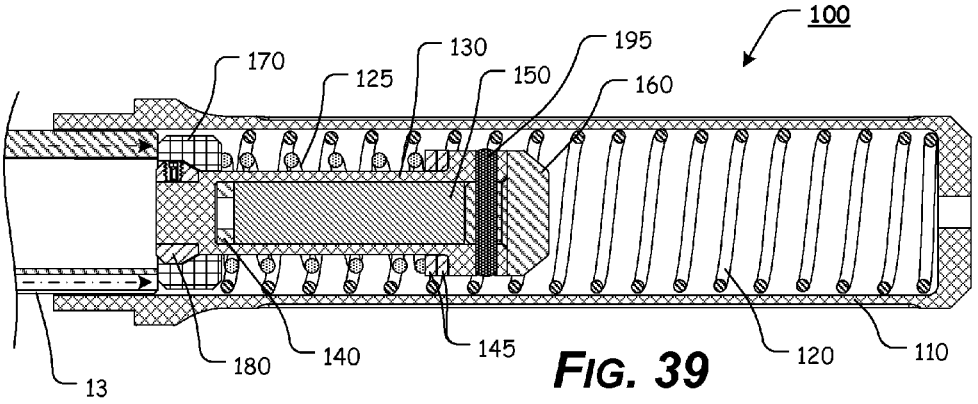
FIG. 39 illustrates an left side, cross-sectional view of certain exemplary components of an exemplary embodiment of a compact recoil management system, assembled according to the presently disclosed systems, methods, and/or apparatuses, wherein the components are in a partially compressed position.
Figure 40:
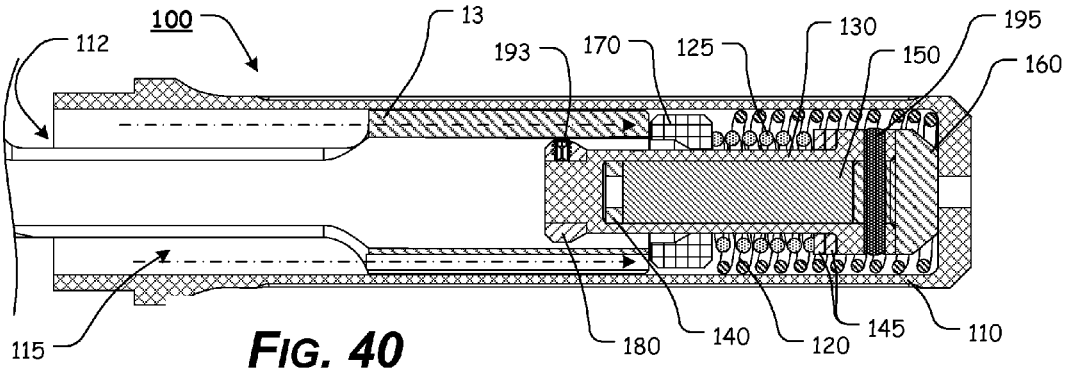
FIG. 40 illustrates an left side, cross-sectional view of certain exemplary components of an exemplary embodiment of a compact recoil management system, assembled according to the presently disclosed systems, methods, and/or apparatuses, wherein the components are in a fully compressed position.

During a firing cycle, as most clearly illustrated in FIGS. 38-40, as the bolt carrier 13 is driven rearward, the rear of the bolt carrier 13 contacts the spacer 170 and urges the spacer 170 rearward, toward the bottom wall 114 of the buffer tube 110. The rearward force exerted on the spacer 170 urges the spacer 170 and, in turn, the buffer 130 rearward, within the interior cavity 115 of the buffer tube 110.

As illustrated in FIG. 39, as the bolt carrier 13 continues to be driven rearward, the resilient spring biasing force of the internal recoil spring 125 continues to maintain the spacer 170 in its position relative to the buffer head 180, as the bolt carrier 130 continues rearward.

As illustrated in FIG. 40, as the bolt carrier 13 continues to be driven rearward, the second end 162 of the end cap 160 contacts the bottom wall 114 within the cavity 115 of the buffer tube 110. If this occurs, and if the recoil force continues to drive the bolt carrier 13 rearward, the spring biasing force of the internal recoil spring 125 is overcome and the spacer 170 compresses the internal recoil spring 125 as it travels rearward, along the buffer body portion 135. When the buffer 130 is in a compressed position, at least a portion of the buffer 130 (and/or the buffer head 180) extends at least partially into an inside diameter of the bolt carrier 13.

When the bolt carrier group reaches its rearmost position, the external recoil spring 120 and the internal recoil spring 125 both provide spring biasing force to the second side 172 of the spacer 170, urging the buffer 130 and the spacer 170 forward. When the spacer 170 contacts the buffer head 180, the bolt carrier 13 and the buffer 130 are urged forward with enough force to drive the bolt carrier 13 forward, toward the chamber, initiating chambering of the waiting round from the magazine into the chamber.

Thus, the external recoil spring 120 is first compressed by the rearward movement of the buffer 130 (and more particularly the spacer 170) until the external recoil spring 120 is about to bottom out (is almost fully compressed). Then, if the second end 162 of the end cap 160 contacts the bottom wall 114 within the cavity 115 of the buffer tube 110, the internal recoil spring 125 begins to compress. The external recoil spring 120 does not compress the internal recoil spring 125, the rearward movement of the rearward movement of the buffer 130 (and more particularly the spacer 170) compress the internal recoil spring 125.

Each of the internal recoil spring 125, the buffer 130, the internal washer 140 (if included), the one or more external washers 145 (if included), the weight 150 (if included), the end cap 160, the spacer 170, and the buffer head 180 contributes to the reciprocating mass, or "dead blow" effect provided by the buffer assembly 100.

Figure 41:
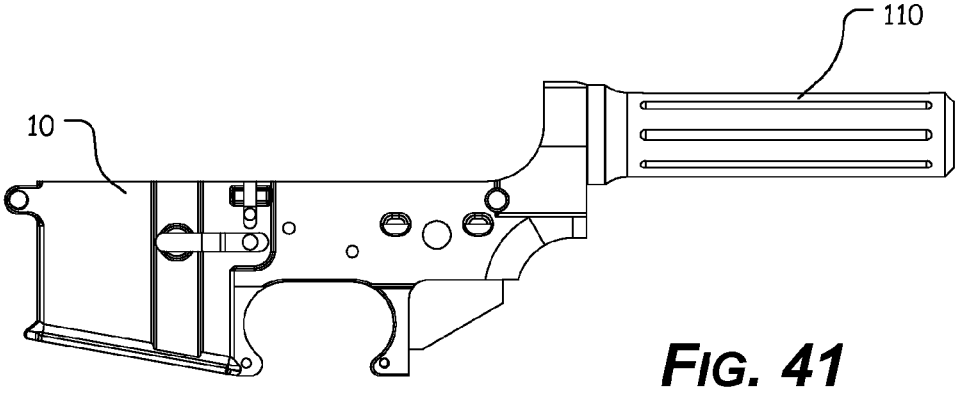
FIG. 41 illustrates a left, side view of an exemplary embodiment of a compact recoil management system being assembled together with a lower receiver, according to the presently disclosed systems, methods, and/or apparatuses.
Figure 42:
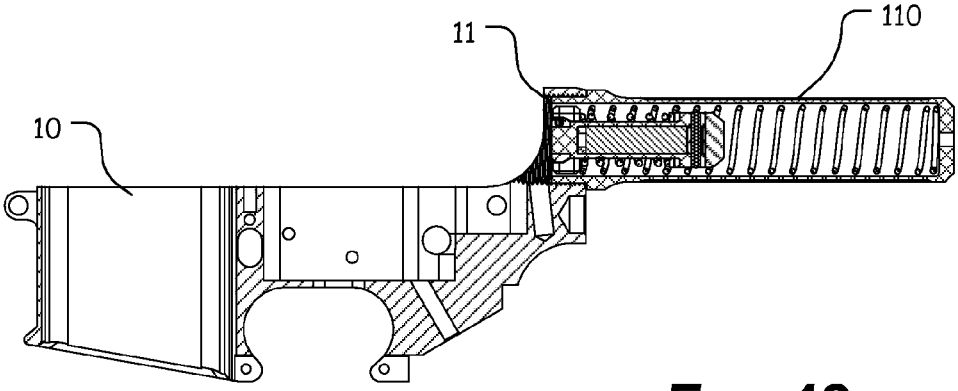
FIG. 42 illustrates a left, side cross-sectional view of certain exemplary components of an exemplary embodiment of a compact recoil management system being assembled together with a lower receiver, according to the presently disclosed systems, methods, and/or apparatuses.

As illustrated most clearly in FIGS. 41-42, the compact recoil management system 100 is illustrated as being utilized in conjunction with a lower receiver 10 and, further, being threadedly connected to the lower receiver 10 via interaction of an externally threaded portion 111 of the buffer tube 110 and an internally threaded buffer tube receiving aperture 11 of the lower receiver 10. It should be appreciated that the lower receiver 10 can be a typical lower receiver for a firearm. It should also be appreciated that a more detailed explanation of the lower receiver 10, the standard features and elements of a receiver that are not related to the present disclosure, instructions regarding how to assemble the lower receiver 10, and certain other items and/or techniques necessary for the implementation and/or operation of the various exemplary embodiments of the present disclosure are not provided herein because such elements are commercially available and/or such background information will be known to one of ordinary skill in the art. Therefore, it is believed that the level of description provided herein is sufficient to enable one of ordinary skill in the art to understand and practice the present disclosure, as described.

While the presently disclosed systems, methods, and/or apparatuses have been described in conjunction with the exemplary embodiments outlined above, the foregoing description of exemplary embodiments of the present disclosure, as set forth above, are intended to be illustrative, not limiting and the fundamental systems, methods, and/or apparatuses should not be considered to be necessarily so constrained. It is evident that the systems, methods, and/or apparatuses are not limited to the particular variation or variations set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belong.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A compact recoil management system, comprising:

(a) a buffer tube, wherein said buffer tube comprises an elongate portion of material extending along a longitudinal axis and having an internal buffer tube cavity defined by an open end, one or more side walls, and a bottom wall;

(b) a buffer recoil spring;

(c) a buffer, wherein said buffer comprises an elongate portion of material extending, along a longitudinal axis, from a first end of said buffer to a second end of said buffer and having an internal buffer cavity defined by an open end, one or more side walls, and a bottom wall, wherein a buffer extension portion extends rearward from said first end of said buffer to a first buffer shoulder, wherein a buffer body portion extends rearward from said first buffer shoulder to a second buffer shoulder, wherein said buffer body portion has a larger outer diameter or size than an outer diameter or size of said buffer extension portion, wherein a buffer head portion extends rearward from said second buffer shoulder to said second end of said buffer, and wherein said buffer head portion has a larger outer diameter or size than an outer diameter or size of said buffer body portion;

(d) an end cap, wherein said end cap extends, along a longitudinal axis, from a first end of said end cap to a second end of said end cap, wherein an end cap extension portion extends rearward from said first end of said end cap to an end cap shoulder, wherein an outer size and shape of said end cap extension portion is such that at least a portion of said end cap extension portion can be fitted through said open end of said buffer cavity and positioned within at least a portion of said buffer cavity, wherein an end cap head portion extends rearward from said end cap shoulder to said second end of said end cap, and wherein said end cap head portion has a larger outer diameter or size than an outer diameter or size of said end cap extension portion;

(e) a spacer, wherein said spacer extends, along a longitudinal axis, from a first end of said spacer to a second end of said spacer, wherein a spacer aperture is formed through said spacer, along said longitudinal axis, wherein a spacer recess extends from said first end of said spacer and is defined by one or more side walls and a spacer recess shoulder, wherein said spacer recess is formed so as to accept at least a portion of said buffer head therein, wherein said spacer aperture has a diameter that is less than a diameter of said spacer recess, wherein an outer diameter or size of said spacer is such that said spacer fits within and is slidable within said internal cavity of said buffer tube; and wherein said buffer recoil spring is positioned along at least a portion of said buffer body portion, between said buffer head portion and said spacer; and (f) a buffer head, wherein said buffer head comprises a buffer head body that extends, along a longitudinal axis, from a first end of said buffer head to a second end of said buffer head, wherein a buffer head aperture is formed through said buffer head, along said longitudinal axis, wherein said buffer head aperture is formed so as to accept at least a portion of said buffer extension portion therein, wherein said buffer head body is formed so as to be at least partially received within at least a portion of said spacer recess.

2. The compact recoil management system of claim 1, wherein said buffer tube includes an externally threaded portion, which extends from said first end of said buffer tube.

3. The compact recoil management system of claim 1, further comprising:

(g) a buffer tube recoil spring, wherein said buffer recoil spring has an external diameter that is less than an internal diameter of said buffer tube recoil spring, wherein said buffer recoil spring has a spring rate or spring biasing force that is less than, equal to, or greater than a spring rate or spring biasing force of said buffer tube recoil spring, and wherein said buffer tube recoil spring is positioned so as to be abutted against and extend from said second side of said spacer.

4. The compact recoil management system of claim 1, wherein said buffer extension portion extends parallel to said longitudinal axis of said buffer.

5. The compact recoil management system of claim 1, wherein said first buffer shoulder extends at an angle that is equal to, greater than, or less than 90° relative to said longitudinal axis of said buffer.

6. The compact recoil management system of claim 1, wherein said second buffer shoulder extends at an angle that is equal to, greater than, or less than 90° relative to said longitudinal axis of said buffer.

7. The compact recoil management system of claim 1, wherein said buffer head portion extends parallel to said longitudinal axis of said buffer.

8. The compact recoil management system of claim 1, wherein said buffer head portion comprises a buffer retaining pin aperture that extends at least partially through said buffer head portion and is formed so as to accept at least a portion of a retaining pin therethrough.

9. The compact recoil management system of claim 1, further comprising an internal washer, wherein said internal washer has an outer diameter that allows said internal washer to be fitted within said internal buffer cavity of said buffer.

10. The compact recoil management system of claim 1, further comprising one or more external washers, wherein each external washer has an inner diameter that allows said external washers to be slidably fitted about said buffer body portion.

11. The compact recoil management system of claim 1, further comprising a weight, wherein said weight is generally cylindrical in shape and is sized so as to be fitted within said internal buffer cavity of said buffer.

12. The compact recoil management system of claim 1, wherein said end cap shoulder extends at an angle that is equal to, greater than, or less than 90° relative to said longitudinal axis of said end cap.

13. The compact recoil management system of claim 1, wherein when said buffer is in a compressed position, at least a portion of said buffer extends at least partially into an inside diameter of a bolt carrier.

14. The compact recoil management system of claim 1, further comprising an end cap retaining aperture that extends at least partially through said end cap extension portion and is formed so as to accept at least a portion of a retaining pin therethrough.

15. The compact recoil management system of claim 1, wherein said spacer recess shoulder extends at an angle that is equal to, greater than, or less than 90° relative to said longitudinal axis of said spacer.

16. The compact recoil management system of claim 1, wherein vertices of said second end of said buffer head and said buffer head body meet at a right angle.

17. The compact recoil management system of claim 1, wherein a chamfer is optionally formed as a transitional between said second end of said buffer head and said buffer head body.

18. The compact recoil management system of claim 1, further comprising a head retaining pin aperture that extends at least from an outer surface of said buffer head body into said buffer head aperture and is formed so as to accept at least a portion of a head retaining pin or set screw therethrough.

19. A compact recoil management system, comprising:

(a) a buffer tube having an internal buffer tube cavity defined by an open end, one or more side walls, and a bottom wall;

(b) a buffer that extends from a first end of said buffer to a second end of said buffer, wherein a buffer extension portion extends rearward from said first end of said buffer to a first buffer shoulder, wherein a buffer body portion extends rearward from said first buffer shoulder to a second buffer shoulder, wherein said buffer body portion has a larger outer diameter or size than an outer diameter or size of said buffer extension portion, wherein a buffer head portion extends rearward from said second buffer shoulder to said second end of said buffer, and wherein said buffer head portion has a larger outer diameter or size than an outer diameter or size of said buffer body portion;

(c) an end cap attached or coupled to said buffer, such that said end cap extends from said buffer head portion of said buffer;

(d) a spacer having a spacer aperture formed through said spacer, wherein a spacer recess extends from a first end of said spacer and is defined by one or more side walls and a spacer recess shoulder, wherein said spacer recess is formed so as to accept at least a portion of said buffer head therein, wherein said spacer aperture has a diameter that is less than a diameter of said spacer recess, wherein said spacer aperture is sized such that said spacer is slidable along at least a portion of said buffer body portion, and wherein an outer diameter or size of said spacer is such that said spacer is slidable within said internal cavity of said buffer tube;

(e) a buffer recoil spring, wherein said buffer recoil spring is positioned along at least a portion of said buffer body portion, between said buffer head portion and said spacer; and (f) a buffer head, wherein a buffer head aperture is formed through said buffer head, wherein said buffer head aperture is formed so as to accept at least a portion of said buffer extension portion therein, and wherein at least a portion of said buffer head is formed so as to be at least partially received within at least a portion of said spacer recess.

20. A compact recoil management system, comprising:

(a) a buffer tube having an internal buffer tube cavity;

(b) a buffer tube recoil spring positioned within said internal buffer tube cavity;

(c) a buffer, wherein a buffer extension portion extends from a first end of said buffer to a first buffer shoulder, wherein a buffer body portion extends from said first buffer shoulder to a second buffer shoulder, wherein said buffer body portion has a larger outer diameter or size than an outer diameter or size of said buffer extension portion, wherein a buffer head portion extends from said second buffer shoulder to a second end of said buffer, and wherein said buffer head portion has a larger outer diameter or size than an outer diameter or size of said buffer body portion;

(d) an end cap attached or coupled to said buffer, such that said end cap extends from said buffer head portion of said buffer;

(e) a spacer having a spacer aperture formed through said spacer, wherein a spacer recess extends from a first end of said spacer and is defined by one or more side walls and a spacer recess shoulder, wherein said spacer is slidable along at least a portion of said buffer body portion, and wherein an outer diameter or size of said spacer is such that said spacer is slidable within said internal cavity of said buffer tube and engageable by said buffer tube recoil spring;

(f) a buffer recoil spring, wherein said buffer recoil spring has an external diameter that is less than an internal diameter of said buffer tube recoil spring, and wherein said buffer recoil spring is positioned along at least a portion of said buffer body portion, between said buffer head portion and said spacer; and (g) a buffer head, wherein said buffer head is attached or coupled to said buffer extension portion.

* * * * *